US005167248A

United States Patent [19]

Tuller

[11] Patent Number: 5,167,248

[45] Date of Patent: Dec. 1, 1992

[54] DISHWASHER RELIEF VALVE

[75] Inventor: Barry E. Tuller, Newton, Iowa

[73] Assignee: Maytag Corporation, Newton, Iowa

[21] Appl. No.: 805,096

[22] Filed: Dec. 9, 1991

[51] Int. Cl.[5] ..... B08B 3/04

[52] U.S. Cl. ..... 137/1; 34/15; 34/51; 134/57 D; 137/199

[58] Field of Search ..... 137/197, 199; 134/57 D, 134/95; 15/304; 34/219, 15, 226, 51, 133 A

[56] References Cited

U.S. PATENT DOCUMENTS

| | | | |
|---|---|---|---|
| 2,674,249 | 4/1954 | Knight | 134/56 |
| 3,126,024 | 3/1964 | Jellies | 34/57 D |
| 3,130,737 | 4/1964 | Jellies | 34/57 D |
| 3,356,431 | 12/1967 | Martiniak | 312/213 |
| 3,362,139 | 1/1968 | Williamson | 55/385 |
| 3,387,388 | 6/1968 | Williamson | 34/234 |
| 3,398,756 | 8/1968 | Kauffman | 134/58 |
| 3,876,469 | 4/1975 | Schimke | 134/95 |
| 4,064,888 | 12/1977 | Diebel | 134/182 |
| 4,188,732 | 2/1980 | Quayle | 34/54 |
| 4,195,419 | 4/1980 | Quayle | 34/231 |
| 4,247,158 | 1/1981 | Quayle | 312/213 |

*Primary Examiner*—Alan Cohan

*Attorney, Agent, or Firm*—Zarley, McKee, Thomte, Voorhees & Sease

[57] ABSTRACT

A relief valve is provided in a dishwasher for relieving an overpressure condition in the washing chamber of the dishwasher. The relief valve includes a cap portion fitting over a chimney opening and a base portion slidably extending into the chimney. The cap portion has a plurality of small perforations allowing for passage of overpressure air flow while precluding the passage of suds.

20 Claims, 2 Drawing Sheets

DISHWASHER RELIEF VALVE

BACKGROUND OF THE INVENTION

This invention relates to the operation of dishwashers, and more specifically to relieving of overpressure caused by normal operation. Normal operation of a dishwasher causes a condition, referred to as overpressure, at the start-up of a wash cycle or when the wash cycle is interrupted and then restarted. Hot water thrown into the air by the wash system rapidly heats the air inside of the washer chamber causing the air to expand, thus increasing internal pressures. This overpressure happens at varying degrees at the beginning of each wash cycle. Failure to relieve this pressure may result in gasket blowouts or undesirable water leaks. Thus, of necessity, there must be a venting means provided in a dishwasher to prevent these adverse consequences. Typical overpressure venting means are through the drying system outlet vent or a water injector port.

Another concern relating to the relief of overpressure is the problem created by the suds from the dishwasher in normal operation, or, should laundry detergent be accidentally substituted for automatic dishwasher detergent. Traditionally, the inlet port for the drying system is located in the bottom of the washing chamber of the dishwasher. This area, being near water level, is subject to sudsing during wash. Thus, any vent located in the bottom of the washing chamber must prevent suds from going through the drying system inlet port or chimney. Conventional dishwashers, such as that described in U.S. Pat. No. 4,247,158, provide a cap or valve that seals on the chimney to prevent suds from passing during the washing cycle and which is lifted during the drying cycle to allow drying air to flow into the chamber when the blower motor is actuated.

SUMMARY OF THE INVENTION

It is an object of the present invention to provide an improved dishwasher relief valve and method of use thereof to relieve overpressure in a dishwasher.

It is a further object of the present invention to allow for passage of overpressure air flow from within the washing chamber while simultaneously precluding the passage of soap suds.

It is a still further object of the present invention to protect the washing chamber from gasket blowouts or inadvertent leaks or other problems caused by overpressure in the washing chamber.

It is a still further object of the present invention to provide a relief valve for venting of overpressure in a dishwasher that is both economical to manufacture and durable in use.

The present invention achieves these objects in a relief valve for a dishwasher having a washing chamber with a bottom wall. The dishwasher also includes a chimney extending upwardly through the bottom wall and terminating in an open upper end. A chimney cover is spaced in covering relation over the upper end of the chimney. The valve includes a cap portion positioned between the upper end of the chimney and the chimney cover and in covering relation to the upper end of the chimney. The valve further includes a base portion extending downwardly from the cap portion and being slidably received within the upper end of the chimney. The cap portion of the valve has a plurality of apertures therein, the apertures allowing overpressure air to flow downwardly therethrough for venting through the chimney and being sufficiently small to prevent the passage of suds.

BRIEF DESCRIPTION OF THE FIGURES OF THE DRAWINGS

The drawings illustrate a preferred embodiment of the invention with similar numerals referring to similar parts throughout the several views, wherein.

DETAILED DESCRIPTION OF THE PREFERRED EMBODIMENT

Figure 1:
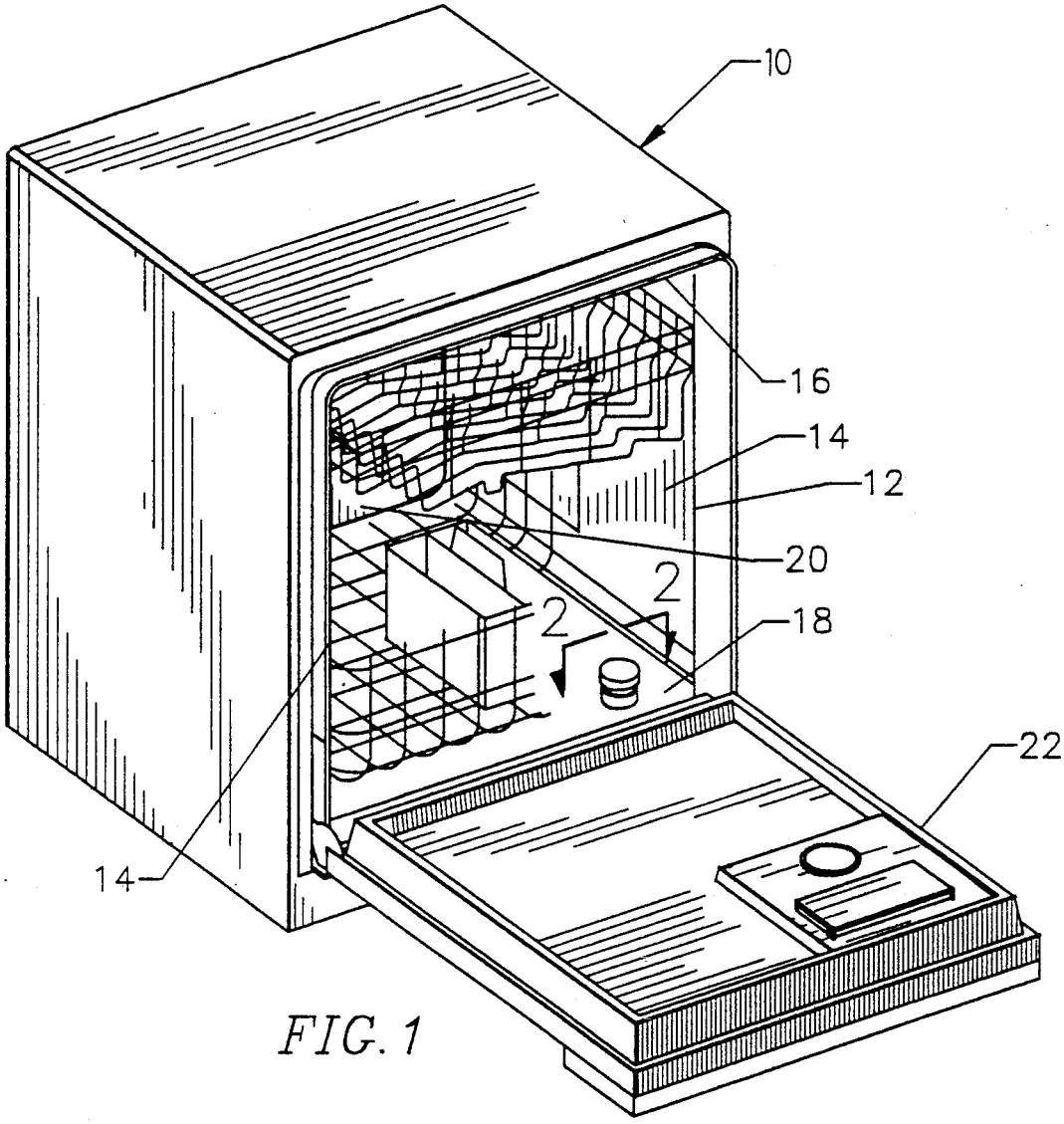
FIG. 1 is a perspective view of a dishwasher with the dishwasher door being open.
Figure 2:
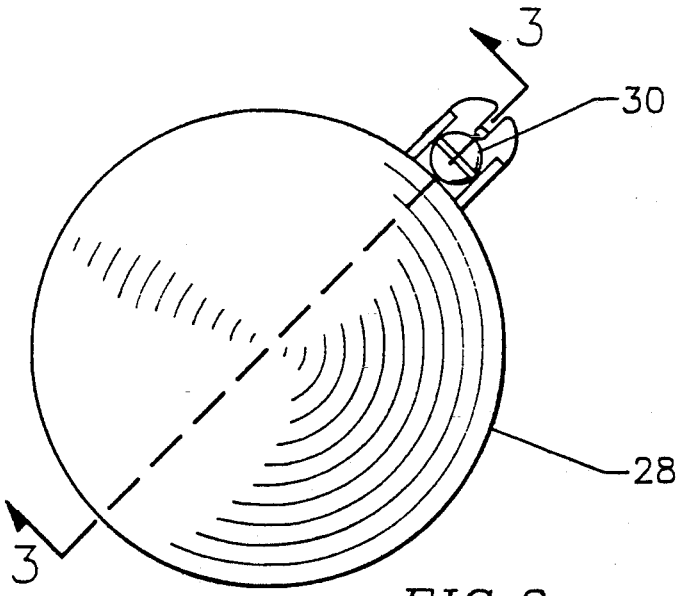
FIG. 2 is a top plan view of the dishwasher dryer chimney assembly.

Referring to the drawings, the reference numeral 10 generally designates a dishwasher. The dishwasher has a washing chamber 12, defined by opposite side walls 14, a top wall 16, a bottom wall 18, a back wall 20, and a door 22.

Figure 3:
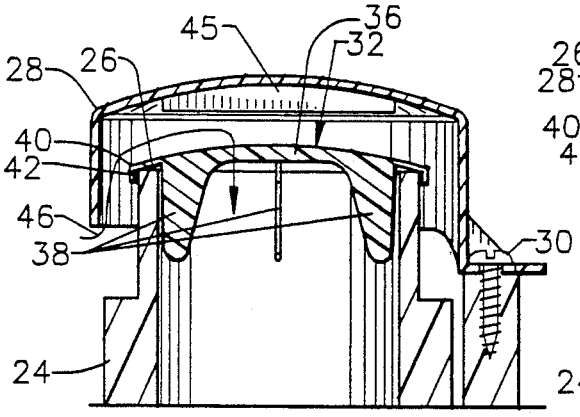
FIG. 3 is a sectional view taken along lines 3—3 of FIG. 2 and showing the relief valve of the present invention in a normal position.

As best seen in FIG. 3, dishwasher 10 includes a dryer system air inlet standpipe or chimney 24 extending upwardly from the bottom wall 18 of the dishwasher. Chimney 24 provides airflow communication from a blower or dryer fan (not shown) to the chamber 12. Chimney 24 terminates in an upper end 26. A chimney cover 28 is secured to chimney 24 by a screw 30.

The above described construction of the dishwasher is conventional and does not constitute a part of the present invention.

The present invention is directed to a relief valve 32 which is received in chimney 24 beneath cover 28. The relief valve 32 is comprised of a cap portion 34 and a base portion 36 extending downwardly from the cap portion 34. Base portion 36 has a plurality of projections or legs 38 which are slidably received within chimney 24. The legs 38 form a diameter which is slightly smaller than the inside diameter of chimney 24, so as to maintain valve 32 in a generally centered position on chimney 24. The cap portion 34 is convex or dome-shaped, and has a perimeter edge 40, which extends radially beyond the upper end 26 of chimney 24. The edge 40 terminates in a downwardly extending lip 42.

The cap portion 34 includes a plurality of small perforations 44, which may be of any shape, such as square, round or slotted. In the drawings, the perforations are shown as square, which is easier to manufacture than round or slotted holes. A preferred dimension of the square perforations is approximately $0.020 \times 0.020$ inches. Perforations 44 are sufficiently small to prevent passage of suds, while allowing overpressure air to flow downwardly therethrough.

Figure 4:
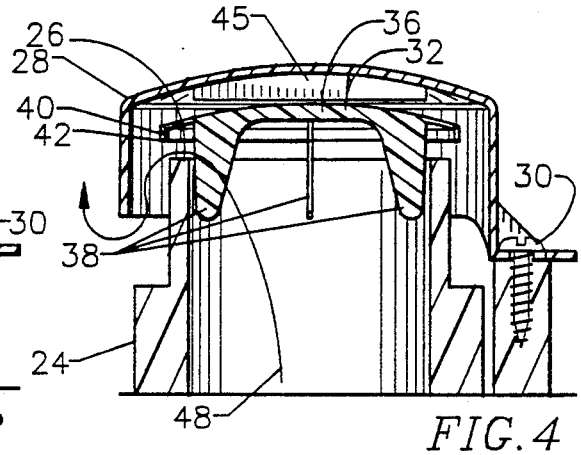
FIG. 4 is a view similar to FIG. 3 showing the relief valve in a raised position.
Figure 5:
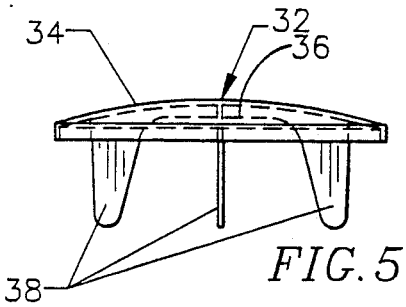
FIG. 5 is a side elevational view of the relief valve.
Figure 6:
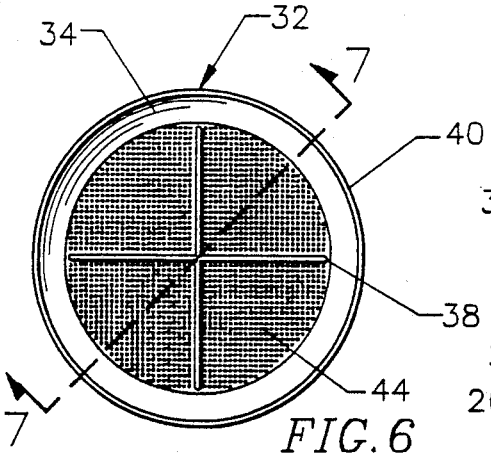
FIG. 6 is a top plan view of the relief valve.
Figure 7:
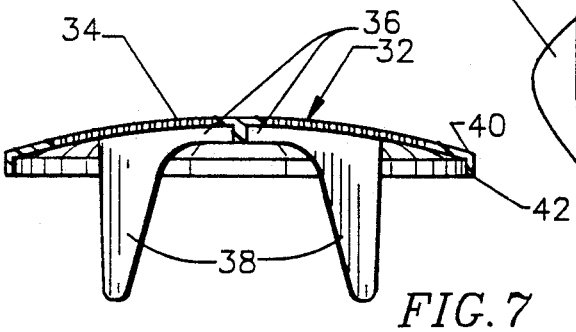
FIG. 7 is a sectional view taken along lines 7—7 of FIG. 6.
Figure 8:
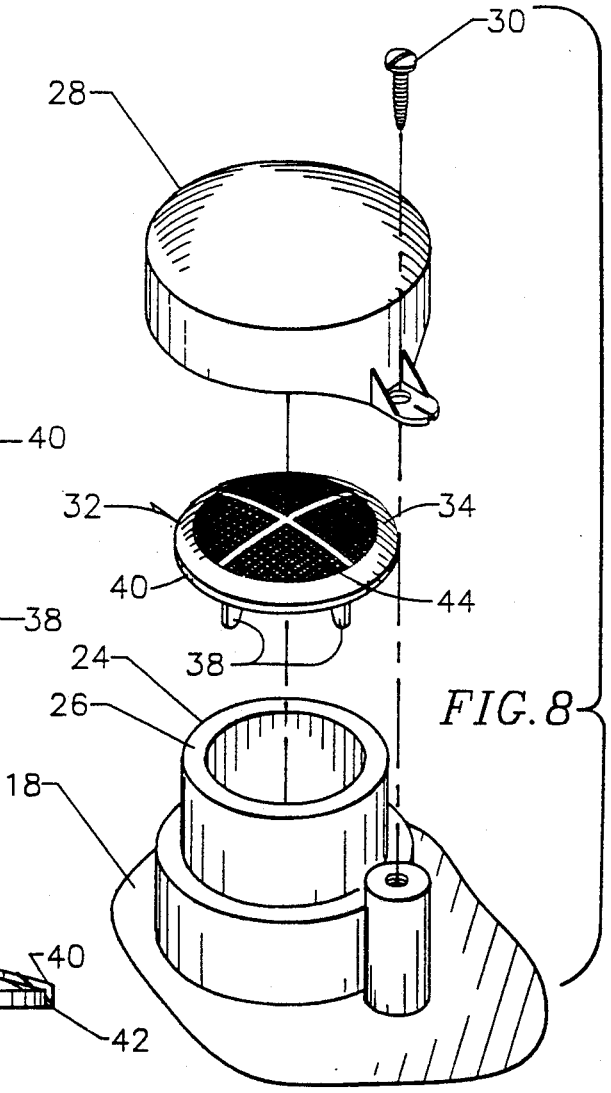
FIG. 8 is an exploded perspective view of the chimney assembly with the relief valve of the present invention.

The curvature of cap portion 34 is sufficient to shed water. For example, cap portion 34 preferably has a circle radius of approximately 4.30 inches. The curvature of cap portion 34 is substantially identical to the curvature of chimney cover 28. Cover 28 includes stop means or ribs 45 to limit the upward movement of valve 32, as seen in FIG. 4.

Valve 32 is preferably made of plastic, though other materials may be used without departing from the scope of the present invention.

In operation, the relief valve 32 normally rests upon the upper edge 26 of chimney 24, as seen in FIG. 3. In this normal position, air from over pressure can pass beneath cover 28 and downwardly through apertures 44 for venting through chimney 24, as shown by arrows 46. The small size of the perforations 44 prevents passage of suds through valve 32. Also, the convex shape of the cap portion 34 acts to shed water, allowing drips of water to run off the perimeter edge 40 and lip 42 outside of chimney 24. During the drying cycle, actuation of the dryer or blower fan (not shown) forces drying air upwardly through chimney 24. This upward movement of air raises valve 32 to the position shown in FIG. 4, thereby allowing the maximum flow of drying air, as shown by arrows 48.

The preferred embodiment of the invention has been set forth in drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

I claim:

1. A relief valve for a dishwasher having a washing chamber with a bottom wall, the dishwasher also having a chimney extending upwardly through the bottom wall and terminating in an open upper end, and a chimney cover spaced in covering relation over the upper end of the chimney, the valve comprising:

a cap portion positioned between the upper end of the chimney and the chimney cover and in covering relation to the upper end of the chimney;

a base portion extending downwardly from the cap portion and being slidably received within the upper end of the chimney; and the cap portion having a plurality of apertures therein, the apertures allowing overpressure air to flow downwardly therethrough for venting through the chimney and being sufficiently small to prevent the passage of suds.

2. The relief valve of claim 1 wherein the cap portion has a perimeter edge extending radially beyond the upper end of the chimney such that the valve is normally in a first position with the cap portion engaging the upper end of the chimney, the valve being movable to a second raised position wherein the cap portion is disengaged from the upper end of the chimney upon actuation of a dryer means in operative communication with the chimney for blowing drying air upwardly through the chimney.

3. The relief valve of claim 1 wherein the cap portion is convex to allow water to shed therefrom.

4. The relief valve of claim 1 wherein the base portion includes projections slidably extending into the interior of the chimney.

5. The relief valve of claim 4 wherein the projections define a diameter slightly less than the inside diameter of the chimney so as to center the valve on the chimney.

6. The relief valve of claim 1 wherein the perforations are square.

7. The relief valve of claim 6 wherein the perforations are approximately 0.020×0.020 inches in size.

8. The relief valve of claim 1 wherein the cap portion has a diameter greater than the diameter of the chimney.

9. The relief valve of claim 1 wherein the cap portion has a downwardly extending perimeter lip.

10. A method for venting of overpressure in a dishwasher, the method comprising:

providing a chimney extending upwardly from the bottom wall of the dishwasher, the chimney being in communication with a drying fan;

placing a perforated cap over the upper end of the chimney; and venting of overpressure air through the perforations while preventing the passage of suds therethrough.

11. An apparatus for relieving an overpressure condition in the washing chamber of a dishwasher, the washing chamber including a bottom wall, the apparatus comprising:

air inlet-outlet means extending into the washing chamber and including a standpipe having an upper end extending above the bottom wall thereof and a cover spaced above the upper end of the standpipe for preventing the escape of active washing fluid through the standpipe; and valve means disposed in the air inlet-outlet means between the cover and the standpipe, including a perforated cap overlying the upper end of the standpipe in a first position for passage of overpressure air flow from within the washing chamber through the perforated cap to atmosphere while precluding the passage of soap suds, the valve means being movable from the first position to a second position above the upper end of the standpipe responsive to operation of a dryer fan operatively connected to the standpipe for permitting dryer fan assisted air flow to enter the washing chamber.

12. The apparatus of claim 11 wherein the valve means further includes a plurality of legs extending downwardly from the cap for sliding receipt within the standpipe so as to guide the movement of the valve means between the first and second positions.

13. The apparatus of claim 12 wherein the legs define a diameter slightly than the inside diameter of the standpipe so as to center the valve means on the standpipe.

14. The apparatus of claim 11 wherein the cap is convex so as to shed water.

15. The apparatus of claim 11 wherein the perforations of the cap are square.

16. The apparatus of claim 15 wherein the perforations are approximately 0.020×0.020 inches in size.

17. The apparatus of claim 11 wherein the cap has a diameter greater than the diameter of the standpipe.

18. The apparatus of claim 11 wherein the cap is substantially circular and has a downwardly extending perimeter lip.

19. A method for venting of overpressure in a dishwasher, the method comprising:

providing a chimney extending upwardly from the bottom wall of the dishwasher, the chimney being in communication with a drying fan;

placing a perforated cap over the upper end of the chimney;

venting of overpressure air through the perforations while preventing the passage of suds therethrough;

movably mounting the cap on the chimney for movement between a first position wherein the cap engages the upper end of the chimney and a second position wherein the cap is disengaged from the upper end of the chimney upon actuation of the dryer fan.

20. A relief valve for a dishwasher having a washing chamber with a bottom wall, the dishwasher also having a chimney extending upwardly through the bottom wall and terminating in an open upper end, the valve comprising:

a cap portion slidably mounted in covering relation to the upper end of the chimney so as to be movable between a first position engaging the upper end of the chimney and a second position disengaged from the upper end of the chimney;

the cap portion having a plurality of apertures therein to allow overpressure air to flow downwardly therethrough for venting through the chimney and being sufficiently small to prevent the passage of suds therethrough.

* * * * *